United States Patent [19]

Waldbillig et al.

[11] 4,132,661

[45] Jan. 2, 1979

[54] LUBRICATING OIL ADDITIVES AND COMPOSITION CONTAINING SAME

[75] Inventors: James O. Waldbillig, Wappingers Falls; Carmen M. Cusano, Poughkeepsie, both of N.Y.

[73] Assignee: Texaco Inc., New York, N.Y.

[21] Appl. No.: 722,897

[22] Filed: Sep. 13, 1976

[51] Int. Cl.[2] ..... C10M 1/32

[52] U.S. Cl. ..... 252/51.5 A; 252/51.5 R; 526/49

[58] Field of Search ..... 252/51.5 R, 51.5 A; 526/49

[56] References Cited

U.S. PATENT DOCUMENTS

| | | | |
|---|---|---|---|
| 3,316,177 | 4/1967 | Dorer | 252/51.5 A |
| 3,458,597 | 7/1969 | Jabloner | 252/51.5 A X |
| 3,676,483 | 7/1972 | Shih-En Hu | 252/51.5 A X |
| 3,687,849 | 8/1972 | Abbott | 252/51.5 A X |
| 3,687,905 | 8/1972 | Dorer | 252/51.5 A |
| 3,769,216 | 10/1973 | Gordon et al. | 252/51.5 R |
| 3,785,980 | 1/1974 | Wilgus | 252/51.5 R X |
| 3,842,010 | 10/1974 | Pappas et al. | 252/51.5 R |
| 3,864,268 | 2/1975 | Culbertson et al. | 252/51.5 AX |
| 3,931,024 | 1/1976 | Shih-En Hu | 252/51.5 R |

*Primary Examiner*—Helen M. S. Sneed

*Attorney, Agent, or Firm*—Thomas H. Whaley; Carl G. Ries; Henry W. Archer

[57] ABSTRACT

Disclosed are lubricating oil additives consisting of the reaction product of a di(lower)alkylamino-(lower-)akylamine and a hydro-peroxidized ethylene/propylene copolymer having utility as dispersants and viscosity index improvers.

4 Claims, No Drawings

LUBRICATING OIL ADDITIVES AND COMPOSITION CONTAINING SAME

BACKGROUND OF THE INVENTION

1. Field of the Invention

The present invention relates generally to additives for lubricating oils used in internal combustion engines, and to lubricating compositions containing such additives.

The additives of the invention combine dispersancy with viscosity index improving. That is to say, they improve the viscosity properties of a lubricant by lessening its tendency to change viscosity as the temperature changes and, at the same time, disperse and maintain suspended sludge, varnish and the like which form in the lubricant during use.

2. Description of the Prior Art

The prior art to which this invention relates is aware of the following U.S. Pat. Nos. 3,789,980 3,687,849; 3,879,304 and 3,076,791. The first of these discloses a lubricating oil additive consisting of the reaction product of a primary or secondary amine, and a hydroperoxidized ethylene/propylene copolymer; U.S. Pat. No. 3,687,849 describes lubricant additives consisting of graft polymers prepared from various polymerizable unsaturated monomers and an oxidized degraded interpolymer of ethylene and propylene. U.S. Pat. No. 3,879,304 reports a terpolymer having thereon a graft of a polymethacrylate. U.S. Pat. No. 3,076,791 discloses lubricating oil additives produced by the free radical reaction of an ethylene/propylene copolymer with an amine.

SUMMARY OF THE INVENTION

The additives of this invention consist of the reaction product of a polyamine containing both tertiary and primary amino groups and a hydroperoxidized ethylene propylene copolymer or a terpolymer (termonomer consisting of an unsaturated hydrocarbon such as a diene, cycloalkene or bicycloalkene) having a molecular weight in the range of 5,000 to 500,000. Examples of suitable types of polyamines include di(lower)alkylamino(lower)alkylamines such as dimethylaminopropylamine, diethylaminopropylamine, or dimethylaminoethylamine and those in which the tertiary amino group exists in a ring system such as 2-aminopyridine, 2-piperidinoethylamine, 5-aminoquinoline, N-(3-aminopropyl)-morpholine or 2-aminopyrimidine.

The additives of this invention have a 210° F thickening power in the range of 1.0 to 100 SUS per 1.0 weight percent of the polymer in lubricating oil.

The additives of the invention are extremely shear stable. They show a characteristic infrared spectrum with absorbance peaks at frequencies in the range of 1550–1750 cm−1.

The additives of the invention are prepared by dissolving the ethylene/propylene polymer in an inert solvent at a temperature of around 70° C using agitation. A free radical initiator such as azo-bis-isobutyronitrile is added and air is bubbled through the reaction medium for 2 to 48 hours. A solvent such as the lubricating oil whose properties are to be improved then is added and the inert solvent is removed by vacuum distillation. Next the amine is introduced into the reaction mass and the mixture is heated for 0.5 to 20 hours at 80 to 250° C under an atmosphere of nitrogen at a pressure of 0 to 1000 p.s.i.g.

The reaction mass again is distilled under vacuum at 80 to 300 degrees C to remove excess amine and catalyst residue. The additive can be precipitated by boiling in isopropyl alcohol and filtered off. The proportions by weight of the starting material can be:

10 to 1000 parts of ethylene/propylene co- or terpolymer
1 to 20 parts of free radical initiator
100 to 100,000 parts of inert solvent
1 to 20 parts of amine
100 to 100,000 parts of oil The dispersant additives of the invention were tested for their effectiveness in mineral lubricating oil compositions in the Dispersancy test and in the Sequence V-C Test.

Of these, the Dispersancy test is conducted by heating the test oil mixed with a synthetic hydrocarbon blowby and a diluent oil at a fixed temperature for a fixed time period. After heating, the turbidity of the resultant mixture is measured. A low % turbidity (0-10) is indicative of good dispersancy while high results (20-100) of oils of increasingly poor dispersancy.

The sequency V-C Test is detailed in the ASTM Special Technical Publication under heading 310-F. The test is used to evaluate crankcase motor oils with respect to sludge and varnish deposits as well as their ability to keep the positive crankcase ventilation (PVC) valve clean and functioning properly. Ratings of 0 to 10 are given, 10 representing absolutely clean and 0 rating representing heavy sludge and varnish deposits.

The rust inhibiting properties of the novel lubricants of the invention were determined in the SE required standard MS-IIC Rust Test. This test was developed and is effective for evaluating crankcase oils with respect to low temperature rusting.

Components used to formulate lubricating compositions containing the additives of the invention are identified below:

| COMPONENT | IDENTITY |
|---|---|
| A | Dinonyldiphenylamine (mostly 4,4' substituted) |
| B | 18:1 overbased calcium sufonate in oil BB |
| C | Ethylene-propylene co-polymer of 20,000 to 50,000 molecular weight (13.0 wt.% in oil CC) |
| D | Polyester type methacrylate copolymer |
| E | Reaction product of sulfurized polybutene and tetraethylene pentamine |
| F | 50% reaction of polybutenyl succinimide (mol. wt. 1300) in oil "BB" |
| G | 10 to 20% hydroperoxidized dimethylaminopropylene aminated ethylene-propylene copolymer in 90 to 80% of oil "CC" |
| H | Zinc dialkyldithiophosphate |

The base oil for the additives of the invention can be predominantly paraffinic or naphthenic or it can be a mixture of both types of mineral oils. In general, the base oil will be a relatively highly refined mineral oil of predominantly paraffinic nature and will have a viscosity in the range of about 30 to about 100 Saybolt Universal Seconds at 210° F.

Typical base oils used in the practise of the invention had the following inspection values:

| Oil No. | Viscosity 100° F | (SUS) 210° F | Gravity | Pour Point (° F) | %S |
|---|---|---|---|---|---|
| AA | 127 | 41.5 | 0.8644 | −5 | 0.16 |
| BB | 98 | 38.8 | 0.8844 | +10 | 0.12 |
| CC | 99 | 39.1 | 0.8639 | 0 | 0.25 |
| DD | 332 | 53.2 | 0.8822 | −5 | 0.40 |
| EE | 846 | 78.1 | 0.8927 | +15 | 0.34 |
| FF | 333 | 53.3 | 0.8838 | +10 | 0.29 |

The invention is further illustrated by the following examples:

EXAMPLE I

Materials:

200 g amorphous copolymer of ethylene and propylene (EPSyn 5006)
8.0 Axo-bis-isobutyronitrile (AIBN)
2000 ml. benzene
4.0 g dimethylaminopropylamine (DMAPA)
1800 g Oil AA Procedure: The e-p copolymer used is sold by the Copolymer Rubber and Chemical Corporation under the name of "EPSyn 5006". Its mole percent ethylene content of the polymer is between 60 and 63 and its molecular weight as expressed by a Mooney viscosity is nominally 50±5 ML 1 + 8 a 250° F with a moisture content of less than 0.5%.

The EPSyn 5006 was dissolved in the benzene at 70° C with stirring. AIBN was added at 70° C and air was bubbled through the rapidly stirred solution at 400 ml/min for 18 hours. After adding Oil AA the solution was stripped to 158° C (0.13 mm). The DMAPA was charged and the solution was heated ten hours at 160° C. Stripping the product to 146° C (0.07 mm) yielded 2007 g. of product (Z).

The sample was filtered through Super-Cel. The polymer, isolated by precipitation in boiing isopropyl alcohol, analyzed 0.10% N.

| Test Data in Oil "AA" | | | |
|---|---|---|---|
| Conc. of Z wt.% in Oil | 5.0 | 10.0 | 15.0 |
| Dispersancy test | 15.0 | 9.5 | 5.5 |
| | (standards: 3.0, 68, 57) | | |
| 210° F Thickening Power (SUS) | — | 8.8 | — |

The composition made above was tested in an engine test under similar conditions as a hydroperoxidized ethylene/propylene copolymer aminated with tetraethylene-pentamine and disclosed in U.S. Pat. No. 3,785,980 (Y) and as a dispersant "X" consisting of a 41% tetrapolymer of butyl, dodecyl, octadecyl and N,N-dimethylaminoalkyl methacrylates in a molar ratio of 21:50:25:4.

The data is given below:

| Blend Comp (wt.%) | I | II | III |
|---|---|---|---|
| Z | 9.0 | — | — |
| Y | — | 9.0 | — |
| Y | — | — | 9.0 |
| Oil AA | 74.1 | 74.1 | 79.10 |
| Oil DD | 10.0 | 10.0 | 10.0 |
| Zinc Dialkyldithiophosphate | 0.65 | 0.65 | 0.65 |
| Overbased calcium sulfonate | 1.00 | 1.00 | 1.00 |
| Ethyl mono and di-nonyldiphenylamine | 0.25 | 0.25 | 0.25 |
| 13 wt.% copolymer ethylene/propylene 20,000–50,000 mol. wt) 87% diluent oil CC) | 5.0 | 5.0 | — |
| Methyl silicone fluid (ppm) | 150 | 150 | — |
| Engine Rust Rating IIC Test | 7.3 | 5.4 | 5.4 |

TABLE I

| Blend No. | | IV Certified (SwRI) | V Screener | VI Screener | VII Screener | VIII Screener |
|---|---|---|---|---|---|---|
| Comp. wt.% | | | | | | |
| Oil | "AA" | 75.81 | 73.37 | 80.39 | 79.19 | Oil "EE" :22.82 Oil "FF" :65.00 |
| | "H" | 1.36 | 1.38 | 1.36 | 1.36 | 1.36 |
| | "A" | 0.25 | 0.25 | 0.25 | 0.25 | 0.25 |
| | "B" | 1.48 | 1.50 | 1.50 | 1.50 | 1.51 |
| | "C" | 6.00 | 6.00 | — | 6.20 | — |
| | "D" | 0.10 | 0.10 | 0.10 | 0.10 | 0.05 |
| | "E" | — | 2.40 | — | — | — |
| | "F" | — | — | 1.40 | 4.70 | 7.01 |
| | "G"** | 1.50 | 1.50 | 2.25 | 1.00 | 0.30 |
| Dispersancy tests | | | | | | |
| | | 2.5 | 2.5* | 3.5 | 4.0 | 3.5 |
| Ref. Oils*** FREO | | | | | | |
| 126 | | 2.5 | 2.5 | 2.5 | 2.5 | 2.5 |
| 127 | | 21.5 | 20.0 | 14.5 | 12.5 | 23.5 |
| 179 | | 69.0 | 64.0 | 48.5 | 31.5 | 64.0 |
| VC ENGINE TEST | | | | | | |
| Ave. Sludge | | 9.5 | 9.7 | 9.7 | 9.7 | 9.5 |
| Ave. Varnish | | 8.2 | 7.9 | 8.0 | 7.1 | 7.5 |
| Piston Skirt Varnish | | 7.0 | 7.9 | 8.0 | 7.2 | 8.1 |
| Oil Ring Clogging | | 0 | 0 | 0 | 0 | 0 |
| Oil Screen Clogging | | 0 | 0 | 0 | 0 | 0 |

*The Dispersancy test was determined with a formulation containing 1.10% of component E.
**Concentration expressed on a "neat" polymer basis.
***The FREO oils are Ford Motor Oils used for referencing the Seq. VC Engine Test.

The explanatory data given above show that the lubricating composition I containing the additive of the invention is superior to one containing a typical additive prepared by the method of U.S. Pat. No. 3,785,980 (II) or a composition containing a methacrylate dispersant-VI improver (III).

Table I gives the results of dispersancy tests which have been conducted with the dimethylaminopropyl amine aminated-ethylene-propylene polymer (G).

As shown in the Table, "G" just barely failed (Avg. Varnish 7.9 vs. 8.0 for SE oil) the dispersancy test with 2.40 wt. % component "E" presents as a supplementary dispersant (Blend No. V). In a formulation where 1.40 wt. % of component "F" was added as a supplementary disperant, a passing SE quality oil was obtained (Blend VI).

Generally, the additives of this invention will be present in the finished composition to the extent of 0.5 to 30 weight percent preferably 9 to 15%. As indicated in the above Examples, detergents, rush inhibitors, anti-oxidants etc., can also be present.

While the proportions of constituents given in the foregoing description give outstanding dispersancy and viscosity improving characteristics with the given base oils, it will be appreciated that by following the teaching of the invention those skilled in the art will be able without undue experimentation to determine optimum composition ranges for other oils.

It is to be understood that the foregoing specific examples are presented by way of illustration and explanation only that the invention is not limited by the details of such examples.

Thus, substantially similar results are obtained with additives prepared by the procedure of Example I and using, in the place of DMAPA, 2-aminopyridine, 2-piperidinoethyl amine, 5-aminoquinoline, N-(3-aminopropyl)-morpholine and 2-aminopyrimidine.

The foregoing is believed to so disclose the present invention that those skilled in the art to which it appertains can, by applying thereto current knowledge, readily modify it for various applications. Therefore, such modifications are intended to fall within the range of equivalence of the appended claims.

We claim:

1. A lubricating composition comprising a major portion of a lubricating oil and an effective dispersing and viscosity improving amount of an additive having a thickening power at 210° F in the range of 1.0 to 100 SUS and an infrared spectrum containing absorbance peaks at frequencies in the range of 1550–1750 $cm^{-1}$. obtained by dissolving in an inert solvent from 10 to 100,000 parts by weight of a ethylene/propylene copolymer or terpolymer of an unsaturated hydrocarbon having a molecular weight of 5000 to 500,000 adding to the resulting solution a free radical iniator catalyst; bubbling air through the reaction medium to hydroperoxidize said copolymer or terpolymer; then adding from 100 to 100,000 parts of said lubricating oil; removing said inert solvent by vacuum distillation; adding 1 to 20 parts by weight of a di(lower)-alkylamino(-lower)alkylamine containing both tertiary and primary amino nitrogen groups; heating the mixture for 0.5 hours to 20 hours at a temperature of 80–250° C under a pressure of 0 to 1000 psig and distilling the reaction mass under vacuum at 80 to 300 degrees C to remove excess polyamine and initiator.

2. A composition in accordance with claim 1, wherein said polyamine is dimethylamino-propylamine and the reaction temperature is 130 to 190° C under a pressure of 5 to 50 psig.

3. The composition of claim 1, wherein said hydrocarbon is a diene, cycloalkene or a bicycloalkene.

4. The composition of claim 1, wherein said additive is present in an amount of 0.5 to 30 percent of weight of said oil.

* * * * *